US010641583B2

(12) United States Patent
Zimmer

(10) Patent No.: US 10,641,583 B2
(45) Date of Patent: May 5, 2020

(54) FIREARM ACCESSORY ELECTRICAL DISTRIBUTION SYSTEM

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 16/040,967

(22) Filed: Jul. 20, 2018

(65) Prior Publication Data

US 2019/0049221 A1 Feb. 14, 2019

Related U.S. Application Data

(60) Provisional application No. 62/534,862, filed on Jul. 20, 2017, provisional application No. 62/581,885, filed on Nov. 6, 2017.

(51) Int. Cl.

| | |
|---|---|
| ***F41G 11/00*** | (2006.01) |
| ***F41G 1/36*** | (2006.01) |
| *F41G 1/35* | (2006.01) |

(52) U.S. Cl.

CPC ..... *F41G 11/003* (2013.01); *F41G 1/36* (2013.01); *F41G 1/35* (2013.01)

(58) Field of Classification Search

CPC .... F41G 11/003; F41G 11/001; F41G 11/004; F41G 1/35; F41G 1/36

USPC ..... 42/117, 124, 148, 135, 84, 90, 114, 115

See application file for complete search history.

(56) References Cited

U.S. PATENT DOCUMENTS

| | | | | |
|---|---|---|---|---|
| 7,845,105 | B1 * | 12/2010 | Cahill | F41C 23/16 200/86 R |
| 7,866,083 | B2 * | 1/2011 | Teetzel | F41G 11/003 342/45 |
| 8,151,505 | B2 * | 4/2012 | Thompson | F41G 11/003 42/84 |
| 8,297,173 | B1 * | 10/2012 | Teetzel | F41G 3/165 42/111 |
| 8,397,418 | B2 * | 3/2013 | Cabahug | F41C 23/22 42/85 |
| 8,695,265 | B2 * | 4/2014 | Dextraze | F41G 1/393 42/115 |
| 8,776,422 | B2 * | 7/2014 | Dodd | F41C 23/22 42/72 |
| 9,417,034 | B1 * | 8/2016 | Swan | F41G 11/008 |
| 9,891,023 | B2 * | 2/2018 | Compton | F41G 11/003 |
| 9,921,028 | B2 * | 3/2018 | Compton | F41C 27/00 |
| 2015/0040456 | A1 * | 2/2015 | Zimmer | F41G 11/003 42/90 |
| 2016/0010949 | A1 * | 1/2016 | Teetzel | F41G 1/35 42/115 |

(Continued)

*Primary Examiner* — John Cooper

(74) *Attorney, Agent, or Firm* — Asgaard Patent Services, LLC; F. Wayne Thompson, Jr.

(57) ABSTRACT

Implementations of a firearm accessory electrical distribution system are provided. The firearm accessory electrical distribution system is an assembly of devices that mechanically and electrically interface to thereby power and/or facilitate the operation of one or more conductively connected power-consuming firearm accessories (e.g., an illumination device, a laser aiming module, a night vision device, etc.). In some implementations, one or more devices of the firearm accessory electrical distribution system may be used to change and set (i.e., program) the mode of operation (e.g., momentary on, constant on, strobe, a combination thereof, etc.) for a conductively connected firearm accessory actuated by a switch of the system.

17 Claims, 8 Drawing Sheets

(56) References Cited

U.S. PATENT DOCUMENTS

2016/0211095 A1* 7/2016 Zimmer ..... F41C 27/00
2018/0364008 A1* 12/2018 Summerfield ..... F41G 11/003

* cited by examiner

FIREARM ACCESSORY ELECTRICAL DISTRIBUTION SYSTEM

CROSS REFERENCE TO RELATED APPLICATION

This application claims the benefit of U.S. Provisional Application Ser. No. 62/534,862, which was filed on Jul. 20, 2017, and U.S. Provisional Application Ser. No. 62/581,885, which was filed on Nov. 6, 2017, the entireties of both applications are incorporated herein by reference.

TECHNICAL FIELD

This disclosure relates to implementations of a firearm accessory electrical distribution system.

BACKGROUND

Modern firearms (e.g., handguns, rifles, and shotguns) are frequently used in conjunction with a variety of electrically powered accessories to enhance the operational capabilities of the user. Electrically powered accessories used in conjunction with a firearm may include, for example, an optical gun sight, night vision device, visual illumination device, infrared illumination device, visible laser, and/or an infrared laser. Due to the variety of electrically powered accessories available, a user may want to attach multiple accessories to a single firearm. The electrically powered accessories, with which a particular firearm is equipped, will be selected based on the purpose for which the firearm is being configured, for example, warfighting, hunting, and/or competitive shooting.

A variety of mounting options have been developed to facilitate the attachment of electrically powered accessories to a firearm. Typically, a mount allows for the attachment of only one electrically powered accessory to a firearm and has no provision for supplying power thereto. Thus, when attaching two or more electrically powered accessories to a firearm, multiple mounts are typically needed and the run time of each accessory is limited by the native power supply, typically batteries stored within the accessory. Because the real estate on a firearm is limited, optimal positioning of two or more electrically powered accessories may be limited as a result of their accompanying mounts. Further, the use of multiple mounts increases the overall weight of the firearm to which they are attached.

Electrically powered firearm accessories are often operated by one or more switches, each switch being configured to activate a mode of operation (e.g., high output, low output, strobe, on/off, etc.) when actuated. Again, because the real estate on a firearm is limited, optimal positioning of a switch assembly, in addition to co-mounted electrically powered accessories, may be difficult to achieve. This is particularly true if the rifle is being setup for ambidextrous use.

Accordingly, it can be seen that needs exist for the firearm accessory electrical distribution system disclosed herein. It is to the provision of a firearm accessory electrical distribution system, that is a streamlined assembly of devices configured to mechanically and electrically interface to thereby power and/or facilitate the operation of one or more conductively connected power-consuming firearm accessories, that the present invention is primarily directed.

SUMMARY OF THE INVENTION

Implementations of a firearm accessory electrical distribution system are provided. The firearm accessory electrical distribution system is an assembly of devices that mechanically and electrically interface to thereby power and/or facilitate the activation of one or more conductively connected power-consuming firearm accessories (e.g., an illumination device, a laser aiming module, a night vision device, etc.). In some implementations, one or more devices of the firearm accessory electrical distribution system may be used to change and set the mode of operation (e.g., momentary on, constant on, strobe, a combination thereof, etc.) for a conductively connected firearm accessory actuated by a switch of the system.

In some implementations, a firearm accessory electrical distribution system may comprise a battery pack having an integrated mode selector switch, a connector extension, a dual switch assembly, an accessory mount having an integrated switch, a mount extension, a mating connector, and/or an interface connector configured to conductively connect a firearm accessory (e.g., a legacy laser aiming module) to the system.

The battery pack may be configured to power the firearm accessory electrical distribution system, including any firearm accessories conductively connected thereto (e.g., a laser aiming module and/or an illumination device). In some implementations, the housing of the battery pack may be configured to contain one or more cylindrical-steel electrochemical cells (i.e., batteries) or a pouch cell therein. The housing of the battery pack is configured so that a bottom side thereof may be secured to a MIL-STD-1913 rail, or another suitable mounting interface.

In some implementations, the battery pack housing may comprise a mode selector switch on a first end thereof and a connector interface (e.g., a socket) on a second end thereof. In some implementations, the mode selector switch of the battery pack may be configured to change and set the mode of operation (e.g., momentary on, constant on, strobe, a combination thereof, etc.) for a firearm accessory (e.g., a laser aiming module and/or an illumination device) actuated by a conductively connected switch of the system.

In some implementations, the battery pack may not include a mode selector switch.

In some implementations, the connector extension may comprise a first connector (e.g., a plug) and a second connector (e.g., a plug) having a cable extending therebetween, each connector is configured to be received within a socket of the firearm accessory electrical distribution system. In this way, for example, the connector extension may be used to conductively connect the battery pack to the dual switch assembly thereby allowing power and/or electronic signals (i.e., data) to pass therebetween.

In some implementations, the dual switch assembly may comprise a housing having a first switch and a second switch positioned to be actuated by a finger of a user, each switch is configured to operate one or more firearm accessories conductively connected thereto when actuated. Also, in some implementations, the system may be configured so that the first switch and/or the second switch may be used to change and set the mode of operation (e.g., momentary on, constant on, strobe, a combination thereof, etc.) for any firearm accessories conductively connected thereto. The housing of the dual switch assembly further comprises a first connector interface (e.g., a socket) and a second connector interface (e.g., a socket). The housing of the dual switch assembly is configured so that a bottom side thereof may be secured to a MIL-STD-1913 rail, or another suitable mounting interface.

In some implementations, the dual switch assembly may include more than two, or less than two, switches.

In some implementations, the accessory mount may comprise a housing having an integrated switch configured to operate one or more firearm accessories conductively connected thereto when actuated, a first connector interface (e.g., a socket), and a second connector interface (e.g., a socket). Also, in some implementations, the system may be configured so that the integrated switch of the accessory mount may be used to change and set the mode of operation (e.g., momentary on, constant on, strobe, a combination thereof, etc.) for any firearm accessories conductively connected thereto. In some implementations, the housing of the accessory mount may be configured so that a bottom side thereof may be secured to a MIL-STD-1913 rail, or another suitable mounting interface.

In some implementations, the accessory mount may include more than one switch.

In some implementations, the mount extension may be configured to conductively connect a firearm accessory (e.g., an illumination device) secured thereon to the accessory mount and thereby the battery pack of the system. In this way, power and/or electronic signals (i.e., data) can pass therebetween.

The mount extension is configured to be removably secured to a first side of the accessory mount. In some implementations, the mount extension may comprise a first end configured to conductively interface with a first side of the accessory mount and a second end configured to conductively interface with a firearm accessory secured thereto (e.g., an illumination device). In this way, for example, power and/or electronic signals (i.e., data) can pass between the accessory mount and the illumination device.

In some implementations, the mount extension may be an integral portion of the accessory mount.

In some implementations, the mating connector may comprise a first connector (e.g., a plug) positioned directly adjacent a second connector (e.g., a plug), each connector is configured to be received within a socket of the firearm accessory electrical distribution system. In this way, a mating connector may be configured to conductively connect two devices (e.g., a battery pack, a dual switch assembly, or an accessory mount) directly together without the use of a connector extension or other electrical cable.

In some implementations, the interface connector may be configured to conductively connect a legacy device (e.g., a laser aiming module such as the AN/PEQ-15) to the accessory mount and thereby the firearm accessory electrical distribution system.

In some implementations, the interface connector may comprise a first connector (e.g., a plug) and a second connector (e.g., a plug) having a cable extending therebetween, the first connector is configured to be received within a socket of the firearm accessory electrical distribution system and the second connector is configured to be received within a power socket of a legacy device. In this way, for example, the interface connector may be used to conductively connect a laser aiming module to the accessory mount and thereby the battery pack, thus allowing power and/or electronic signals (i.e., data) to pass therebetween.

In some implementations, a computer implemented program (or application) may be used to configure the operation of the firearm accessory electrical distribution system. More specifically, the computer implemented program may be used to change and set how power is shared between the devices of the system (e.g., the battery pack and the illumination device) and/or the mode of operation for any firearm accessories (e.g., the laser aiming module and/or the illumination device) conductively connected to a switch of the system.

As another example, in some implementations, the firearm accessory electrical distribution system may comprise an accessory mount having an integrated switch, a mount extension, and an illumination device. The system may be powered by one or more batteries contained within the illumination device. In some implementations, the integrated switch of the accessory mount is configured to operate (e.g., turn on/off) the illumination device conductively connected thereto via the mount extension.

As yet another example, in some implementations, the firearm accessory electrical distribution system may comprise a dual switch assembly, an accessory mount having an integrated switch, a mating connector, and an illumination device conductively connected to a first side of the accessory mount. The system may be powered by one or more batteries contained within the illumination device and the mating connector may be used to conductively connect the dual switch assembly to the accessory mount. In some implementations, the first switch or the second switch of the dual switch assembly, or the integrated switch of the accessory mount, or a combination thereof, may be configured to operate the illumination device conductively connected to the accessory mount.

As still yet another example, in some implementations, the firearm accessory electrical distribution system may comprise a laser aiming module, a switch assembly, and an illumination device conductively connected to a first side of the laser aiming module. The system may be powered by one or more batteries contained within the illumination device. The housing of the laser aiming module is configured so that a bottom side thereof may be secured to a MIL-STD-1913 rail, or another suitable mounting interface.

In some implementations, the laser aiming module may be configured to emit a visible laser and/or an IR laser that can be used to aim a firearm equipped with the firearm accessory electrical distribution system. In some implementations, the laser aiming module may be configured to conductively connect directly to the switch assembly. In some implementations, the laser aiming module may comprise a housing having a first switch, a mode selector switch, and a mounting interface on the first side thereof.

In some implementations, the first switch of the laser aiming module can be configured to operate (e.g., activate) the laser aiming module, and/or any firearm accessories conductively connected thereto, when actuated.

In some implementations, the mode selector switch of the laser aiming module may be configured to change and set the mode of operation (e.g., momentary on, constant on, strobe, a combination thereof, etc.) for a firearm accessory (e.g., an illumination device) actuated by a conductively connected switch of the system. In some implementations, the mode selector switch of the laser aiming module may be configured to selectively power firearm accessories (e.g., the illumination device) conductively connected to the first switch of the laser aiming module.

As yet another example, in some implementations, the firearm accessory electrical distribution system may comprise a laser aiming module, a switch assembly, an illumination device, and a remote cable adaptor configured to conductively connect the illumination device to the laser aiming module and the one or more switches of the system. In this way, a user may be afforded more flexibility when positioning the illumination device on the handguard, or other portion, of a firearm (e.g., a rifle). The system may be powered by one or more batteries contained within the illumination device. The housing of the laser aiming module is configured so that a bottom side thereof may be secured to a MIL-STD-1913 rail, or another suitable mounting interface.

In some implementations, the remote cable adaptor may comprise a first connector (e.g., a plug) and a second connector (e.g., a plug) having a cable extending therebetween, the first connector of the remote cable adaptor may be configured to be removably received within the mounting interface of the laser aiming module and the second connector may be configured to interface with the power socket of a legacy device (e.g., an illumination device). In this way, for example, the remote cable adaptor may be used to conductively connect the illumination device to the laser aiming module and the switch assembly, thereby allowing power and/or electronic signals (i.e., data) to pass therebetween.

BRIEF DESCRIPTION OF THE DRAWINGS

Like reference numerals refer to corresponding parts throughout the several views of the drawings.

DETAILED DESCRIPTION

Figure 1A:
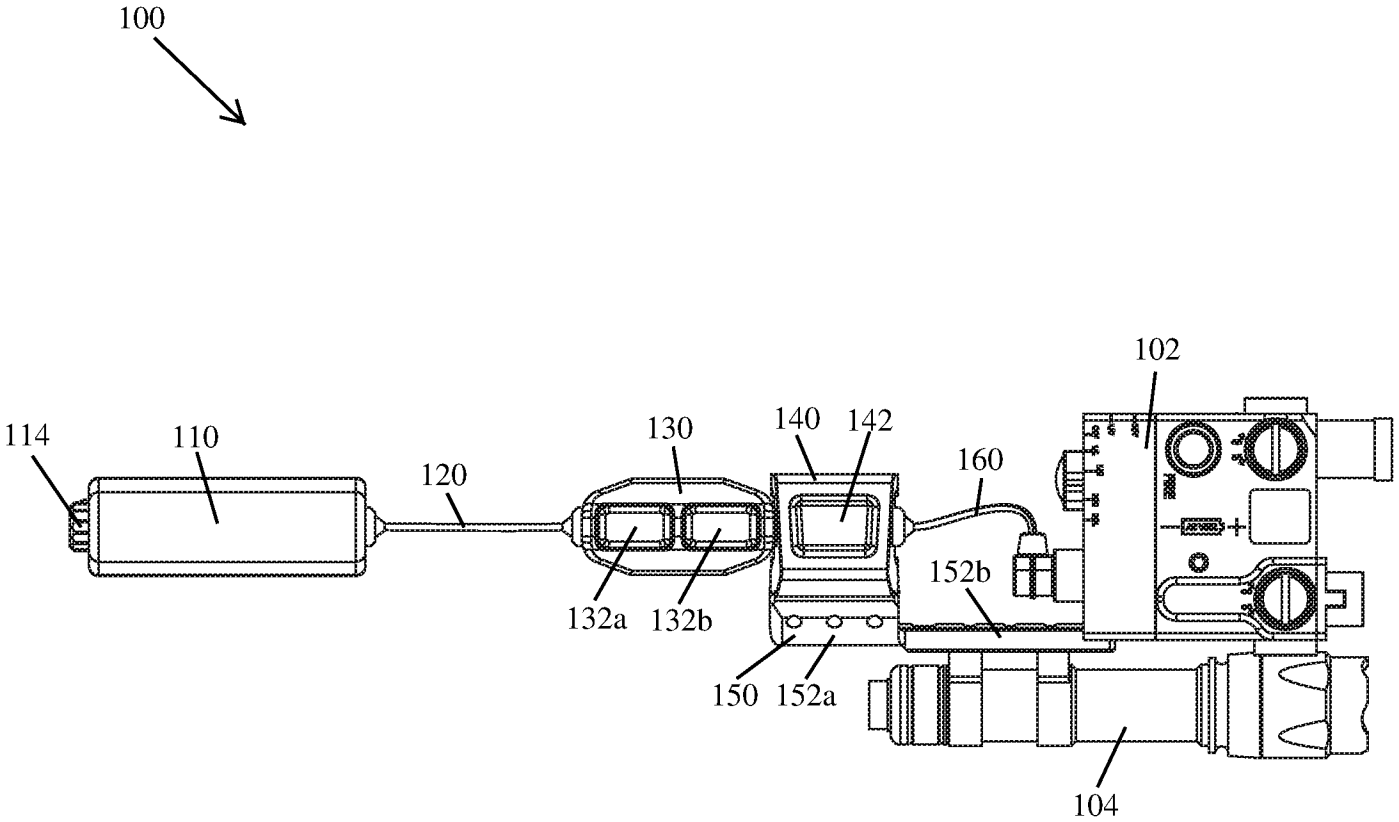
FIG. 1A illustrates a top view of a firearm accessory electrical distribution system according to the principles of the present disclosure.
Figure 1B:
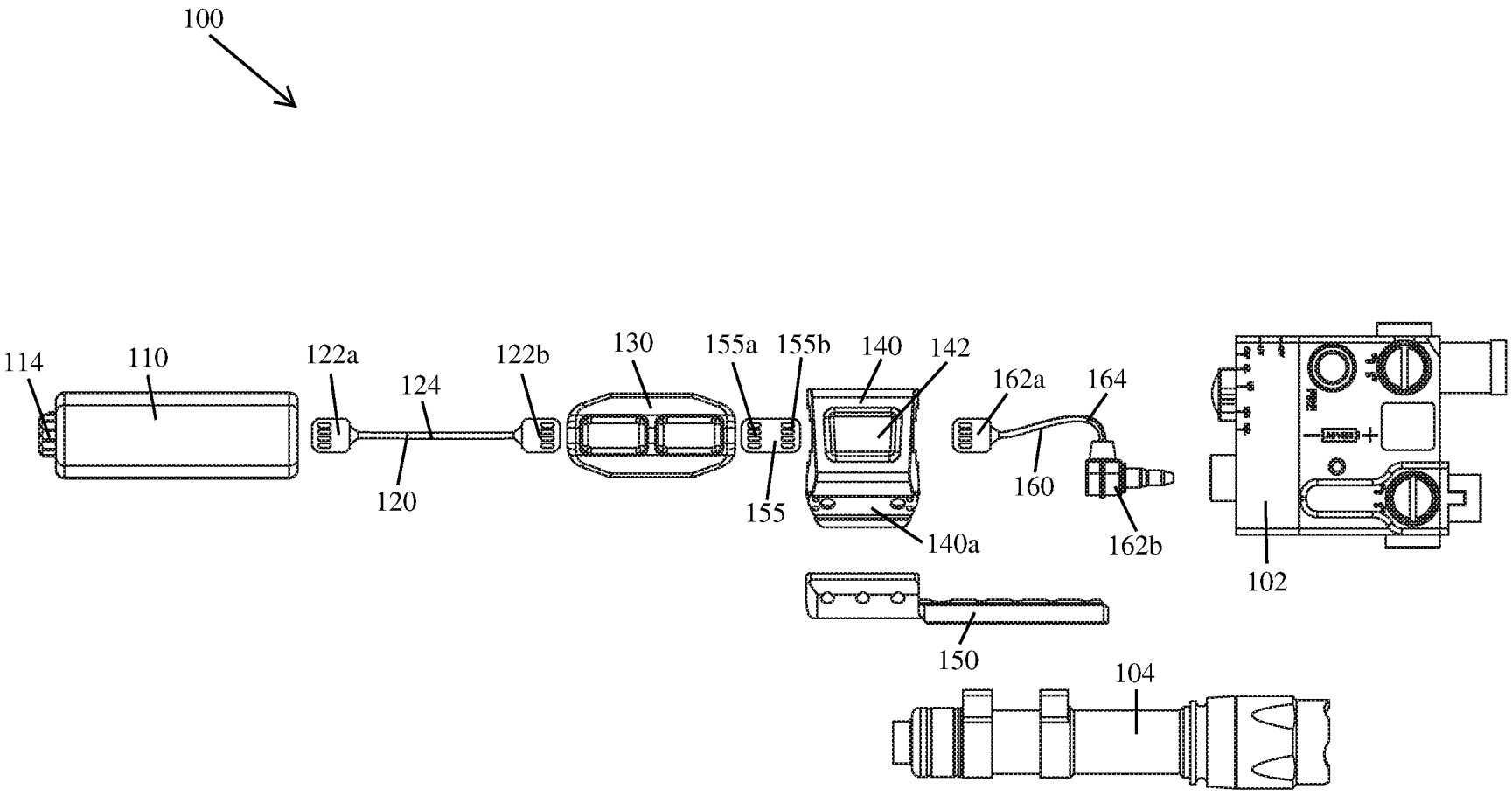
FIG. 1B illustrates a top view of the firearm accessory electrical distribution system shown in FIG. 1A, wherein the components thereof are separated and fasteners have been omitted for clarity.
Figure 1C:
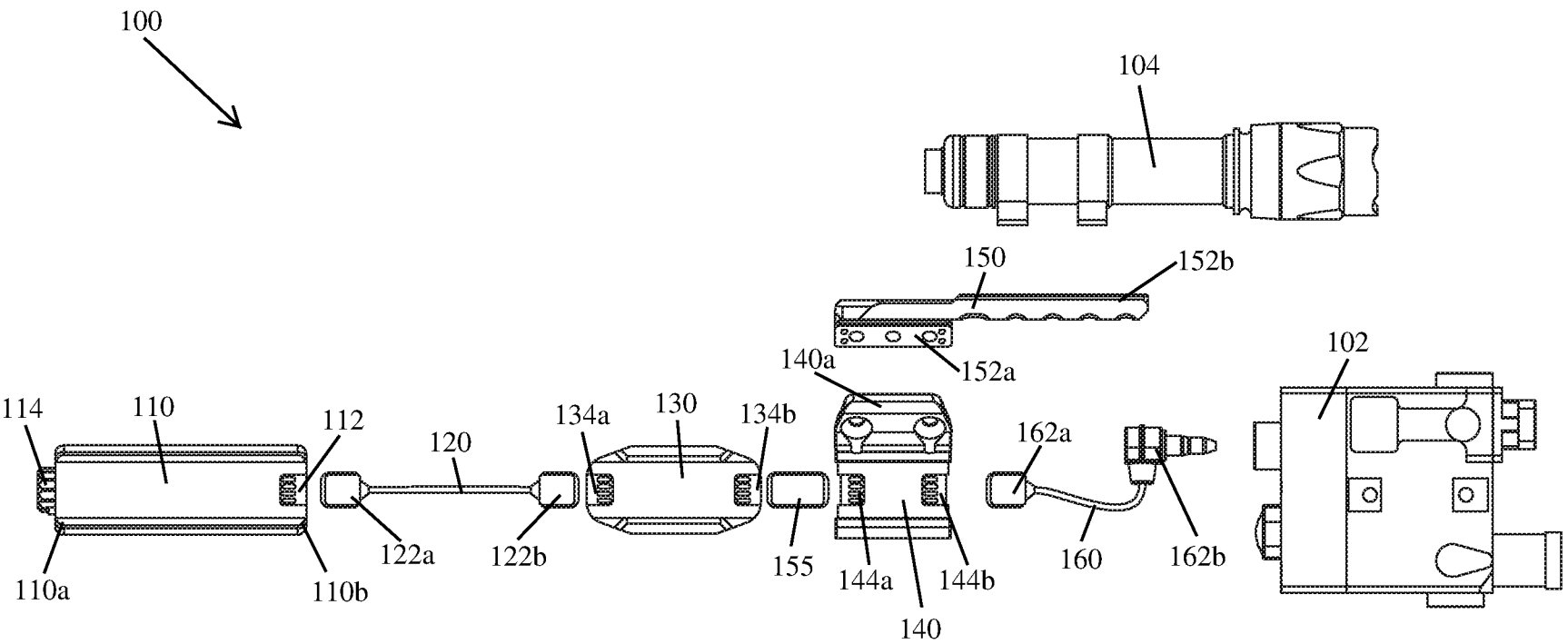
FIG. 1C illustrates a bottom view of the firearm accessory electrical distribution system shown in FIG. 1A, wherein the components thereof are separated and fasteners have been omitted for clarity.

FIGS. 1A-1C illustrate an example implementation of a firearm accessory electrical distribution system 100. The firearm accessory electrical distribution system 100 is an assembly of devices that mechanically and electrically interface to thereby power and/or facilitate the operation of one or more conductively connected power-consuming firearm accessories (e.g., an illumination device, a laser aiming module, a night vision device, etc.). In some implementations, as discussed in greater detail below, one or more devices of the system 100 may be used to change and set (i.e., program) the mode of operation (e.g., momentary on, constant on, strobe, a combination thereof, etc.) for a conductively connected firearm accessory actuated by a switch of the system 100.

As shown in FIGS. 1A-1C, in some implementations, a firearm accessory electrical distribution system 100 may comprise a battery pack 110 having an integrated mode selector switch 114, a connector extension 120, a dual switch assembly 130, an accessory mount 140 having an integrated switch 142, a mount extension 150, a mating connector 155, and/or an interface connector 160 for conductively connecting a firearm accessory (e.g., a legacy laser aiming module 102) to the system 100.

As shown in FIG. 1A, in some implementations, the battery pack 110 may be configured to power the system 100 and/or one or more firearm accessories conductively connected thereto (e.g., a laser aiming module 102 and/or an illumination device 104). In some implementations, when used in conjunction with a battery-powered firearm accessory (e.g., the illumination device 104), the battery pack 110 may be configured to work in conjunction with the native power source (e.g., one or more batteries stored in the barrel of the illumination device 104) to power the firearm accessory conductively connected thereto. In some implementations, when used in conjunction with a battery-powered firearm accessory (e.g., the illumination device 104), the battery pack 110 may be used in lieu of the native power source to power the firearm accessory conductively connected thereto. In some implementations, the battery pack 110 may be configured to power one or more devices that are conductively connected thereto in parallel and/or series.

As shown in FIG. 1C, in some implementations, the battery pack 110 may comprise a housing having a mode selector switch 114 on a first end 110*a* thereof and a connector interface 112 on a second end 110*b* thereof.

In some implementations, the housing of the battery pack 110 may be configured to contain one or more cylindrical-steel electrochemical cells (i.e., batteries) or a pouch cell therein. In some implementations, the housing of the battery pack 110 may be configured so that a bottom side thereof may be secured to a MIL-STD-1913 rail, also referred to as a Picatinny rail. In some implementations, the housing of the battery pack 110 may be configured so that a bottom side thereof may be secured to one or more negative space mounting slots (e.g., M-LOK standard and/or KeyMod standard negative space mounting slot(s)).

As shown in FIG. 1A, in some implementations, the mode selector switch 114 of the battery pack 110 may be configured to change and set the mode of operation (e.g., momentary on, constant on, strobe, a combination thereof, etc.) for a firearm accessory (e.g., the laser aiming module 102 and/or the illumination device 104)) actuated by a conductively connected switch (e.g., 132*a*, 132*b*, 142) of the system.

In some implementations, the mode selector switch 114 of the battery pack 100 may be a rotary switch, or another suitable switch type known to one of ordinary skill in the art.

In some implementations, the battery pack 110 may not include a mode selector switch 114.

As shown in FIG. 1C, in some implementations, the connector interface 122 of the battery pack 110 may be a conductive female receptacle (i.e., a socket).

As shown in FIG. 1B, in some implementations, the connector extension 120 may comprise a first connector 122*a* and a second connector 122*b* having a cable 124 extending therebetween, each connector 122*a*, 122*b* is configured to be removably received by a conductive female receptacle (e.g., 112, 134*a*, 134*b*, 144*a*, 144*b*) of the system 100 (see, e.g., FIG. 1C). In this way, for example, the connector extension 120 may be used to conductively connect the battery pack 110 to the dual switch assembly 130, thereby allowing power and/or electronic signals (i.e., data) to pass therebetween. In some implementations, the connector extension 120 may be configured to allow for a series and/or parallel connection between one or more conductively connected switches (e.g., 132*a*, 132*b*, 142) and/or other accessories (e.g., the laser aiming module 102 and/or the illumination device 104) conductively connected to the system 100.

As shown in FIG. 1A, in some implementations, the dual switch assembly 130 may comprise a housing having a first switch 132*a* and a second switch 132*b* on a top side thereof, each switch 132*a*, 132*b* is configured to operate (e.g., activate) one or more firearm accessories conductively connected thereto when actuated. Also, in some implementations, the system 100 may be configured so that the first switch 132*a* and/or the second switch 132*b* of the dual switch assembly 130 may be used to change and set the mode of operation (e.g., momentary on, constant on, strobe, a combination thereof, etc.) for any firearm accessories conductively connected thereto. In some implementations, the dual switch assembly 130 may further comprise a first connector interface 134*a* and a second connector interface 134*b* (see, e.g., FIG. 1C). In some implementations, the housing of the dual switch assembly 130 may be configured so that a bottom side thereof may be secured to a MIL-STD-1913 rail, also referred to as a Pica tinny rail. In some implementations, the housing of the dual switch assembly 130 may be configured so that a bottom side thereof may be secured to one or more negative space mounting slots (e.g., M-LOK standard and/or KeyMod standard negative space mounting slot(s)).

In some implementations, the first switch 132*a* and/or the second switch 132*b* of the dual switch assembly 130 may comprise a force sensing resistor, a dome switch, or another suitable switch type known to one of ordinary skill in the art.

In some implementations, the switch assembly 130 may include more than two, or less than two, switches 132.

A shown in FIG. 1C, in some implementations, the first connector interface 134*a* and/or the second connector interface 134*b* of the dual switch assembly 130 may be a conducive female receptacle (i.e., a socket).

As shown in FIG. 1A, in some implementations, the accessory mount 140 may comprise a housing having an integrated switch 142 positioned to be actuated by a finger of a user, the integrated switch 142 is configured to operate one or more firearm accessories conductively connected thereto when actuated. Also, in some implementations, the system may be configured so that the integrated switch 142 of the accessory mount 140 may be used to change and set the mode of operation (e.g., momentary on, constant on, strobe, a combination thereof, etc.) for any firearm accessories conductively connected thereto (e.g., the laser aiming module 102 and/or the illumination device 104). In some implementations, the accessory mount 140 may further comprise a first connector interface 144*a* and a second connector interface 144*b* (see, e.g., FIG. 1C). In some implementations, the housing of the accessory mount 140 may be configured so that a bottom side thereof may be secured to a MIL-STD-1913 rail, also referred to as a Picatinny rail. In some implementations, the housing of the accessory mount 140 may be configured so that a bottom side thereof may be secured to one or more negative space mounting slots (e.g., M-LOK standard and/or KeyMod standard negative space mounting slot(s)).

In some implementations, the switch 142 of the accessory mount 140 may comprise a force sensing resistor, a dome switch, or another suitable switch type known to one of ordinary skill in the art.

In some implementations, the accessory mount 140 may include more than one switch 142.

As shown in FIG. 1C, in some implementations, the first connector interface 144*a* and/or the second connector interface 144*b* of the accessory mount 140 may be a conducive female receptacle (i.e., a socket).

As shown in FIG. 1A, in some implementations, the mount extension 150 may be configured to conductively connect a firearm accessory secured thereon (e.g., the illumination device 104) to the accessory mount 140 and thereby the battery pack 110 of the system 100. In this way, power and/or electronic signals (i.e., data) may pass therebetween.

As shown in FIGS. 1A and 1B, in some implementations, the mount extension 150 may be configured to be removably secured to a first side 140*a* of the accessory mount 140. In some implementations, the mount extension 150 may comprise a first end 152*a* configured to conductively interface with the first side 140*a* of the accessory mount 140 and a second end 152*b* configured to conductively interface with a firearm accessory (e.g., an illumination device 104) positioned thereon (see, e.g., FIG. 1A). In this way, for example, power and/or electronic signals (i.e., data) may pass between the accessory mount 140 and the illumination device 104. In some implementations, the mount extension 150 may be configured to position a firearm accessory secured thereto in front of the accessory mount 140 (see, e.g., FIG. 1A).

In some implementations, one or more threaded fasteners may be used to secure the first end 152*a* of the mount extension 150 to the first side 140*a* of the accessory mount 140. In some implementations, the mount extension 150 may be an integral portion of the accessory mount 140.

As shown in FIG. 1B, in some implementations, the mating connector 155 may comprise a first connector 155*a* positioned directly adjacent a second connector 155*b*. In some implementations, a mating connector 155 may be configured to conductively connect two devices (e.g., a battery pack 110, a dual switch assembly 130, or an accessory mount 140) directly together without the use of a connector extension 120 or other electrical cable.

As shown in FIG. 1B, in some implementations, the first connector 155*a* and/or the second connector 155*b* of a mating connector 155 may each be a conductive male portion (i.e., a plug) configured to be removably received by a conductive female receptacle (e.g., 112, 134*a*, 134*b*, 144*a*, 144*b*) of the firearm accessory electrical distribution system 100. In this way, for example, the mating connector 155 may be used to conductively connect the accessory mount 140 directly to the dual switch assembly 130, thereby allowing power and/or electronic signals (i.e., data) to pass therebetween. In some implementations, the mating connector 155 may be configured to allow for a series and/or a parallel connection between one or more conductively connected switches (e.g., 132*a*, 132*b*, 142) and/or other accessories (e.g., the laser aiming module 102 and/or the illumination device 104) conductively connected to the system 100.

As shown in FIG. 1A, in some implementations, the interface connector 160 may be configured to conductively connect legacy devices (e.g., the laser aiming module 102) to the accessory mount 140 and thereby the firearm accessory electrical distribution system 100. In this way, for example, one or more switches (e.g., 132*a*, 132*b*, 142) of the system 100 may be used to operate the conductively connected accessory.

As shown in FIG. 1B, in some implementations, the interface connector 160 may comprise a first connector 162*a* and a second connector 162*b* having a cable 164 extending therebetween, the first connector 162*a* is configured to be received by a conductive female receptacle (e.g., 112, 134*a*, 134*b*, 144*a*, 144*b*) of the system 100 and the second connector 162*b* is configured to interface with a power socket of a legacy device (e.g., the laser aiming module 102). In this way, for example, the interface connector 160 may be used to conductively connect the laser aiming module 102 to the accessory mount 140 and thereby the battery pack 110, thus allowing power and/or electronic signals (i.e., data) to pass therebetween.

Figure 6:
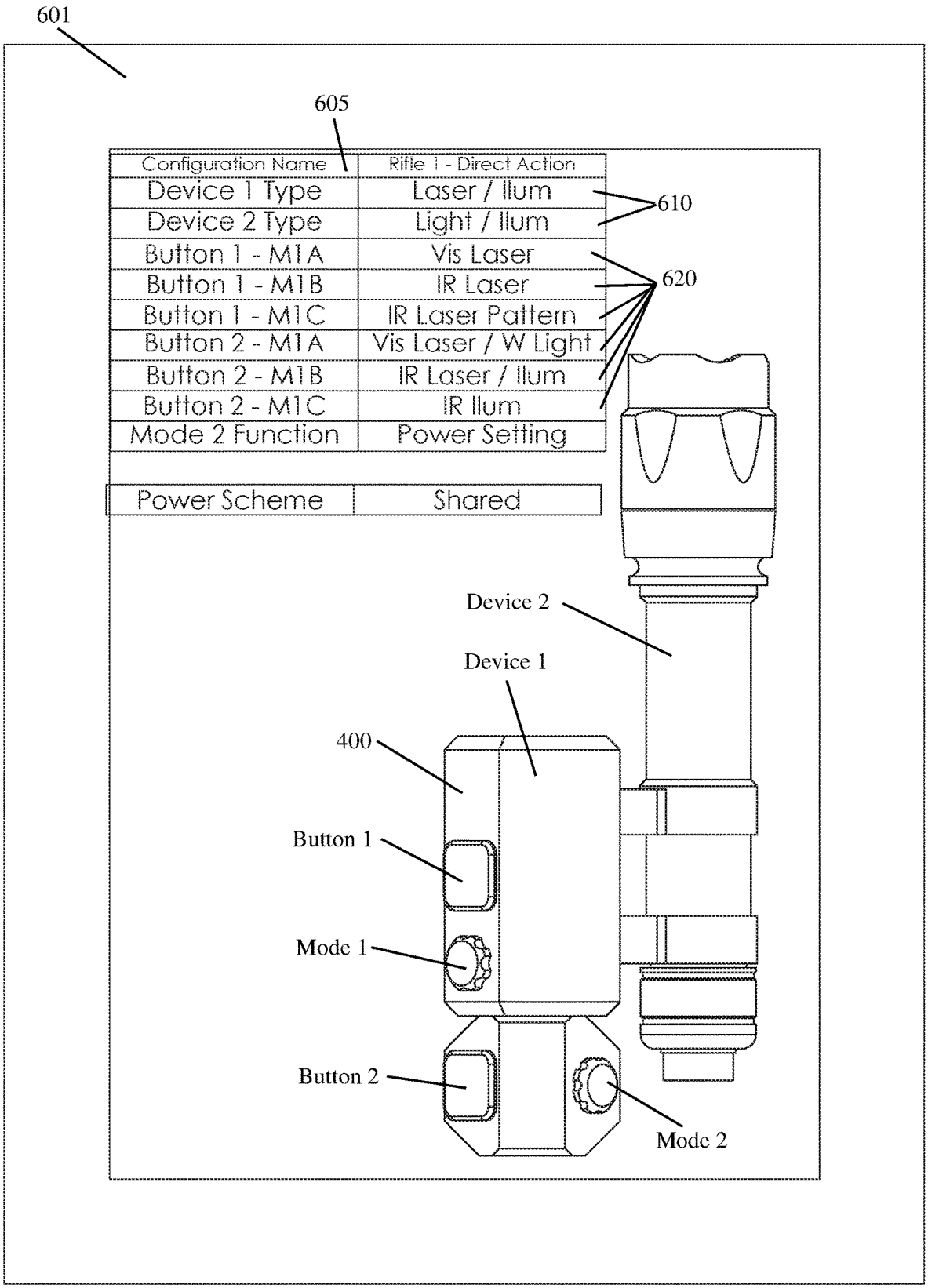
FIG. 6 illustrates an example computer display showing an interface of a computer implemented program (or application) that may be used to configure the operation of firearm accessories conductively connected to a firearm accessory electrical distribution system.

In some implementations, as shown in FIG. 6, a computer implemented program (or application) may be used to configure the operation of the firearm accessory electrical distribution system 100. More specifically, the computer implemented program may be used to change and set how power is shared between the devices of the system 100 (e.g., the battery pack 110 and the illumination device 104) and/or the mode of operation for any firearm accessories (e.g., the laser aiming module 102 and/or the illumination device 104) conductively connected to a switch (e.g., 132*a*, 132*b*, 142) of the system 100.

In some implementations, each individual device (e.g., the battery pack 110, the dual switch assembly 130, the accessory mount 140, and the mount extension 150) of a system 100 may rely on an independent simple circuit or a complex integrated circuit. For example, in some implementations, the accessory mount 140 may comprise a polymer housing having a dome switch that closes a mechanical circuit for the one or more firearm accessories conductively connected thereto. Or, in some implementations, the accessory mount 140 may include a mode selector switch that is configured to allow a user to change and set the mode of operation for any conductively connected firearm accessories. Further, in some implementations, as discussed above, the system 100 may be configured so that the switch 142 of the accessory mount 140 can be used to change and set the mode of operation (e.g., momentary on, constant on, strobe, a combination thereof, etc.) for any firearm accessories conductively connected thereto (i.e., the switch 142 may be used to select and/or set a program).

Figure 2A:
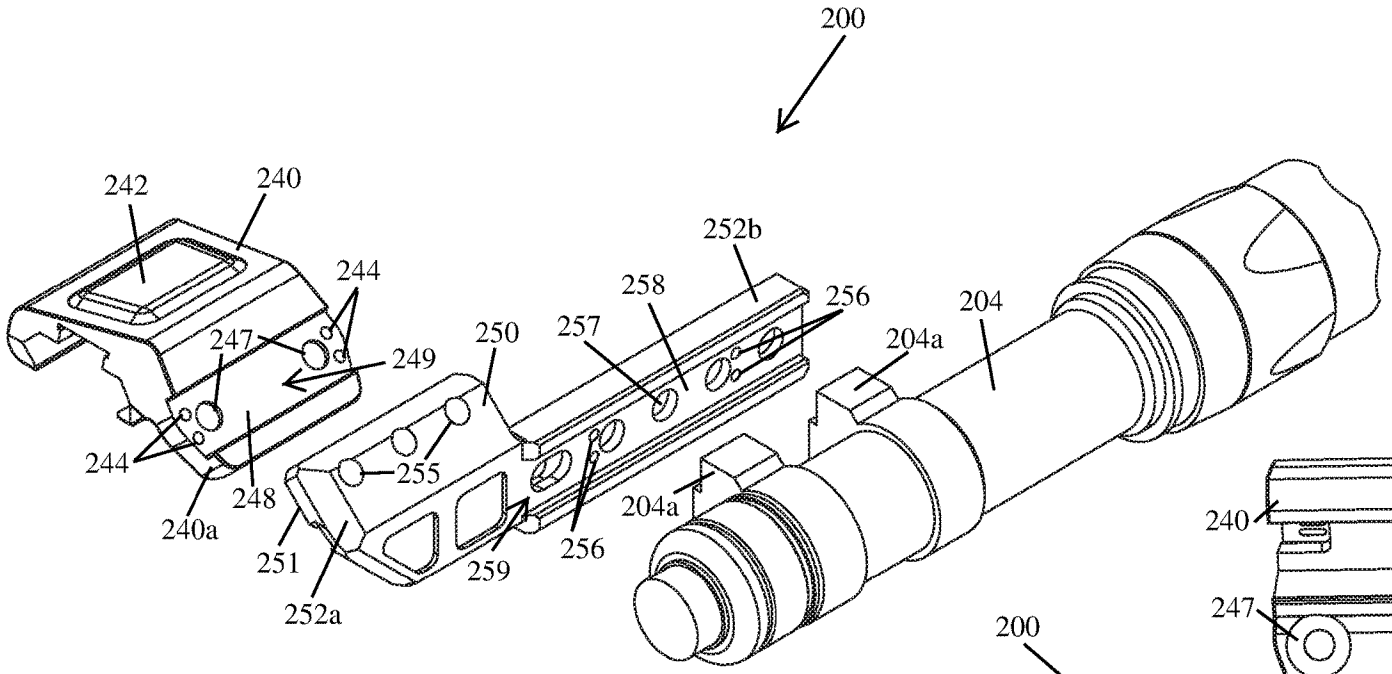
FIGS. 2A and 2B illustrate another example implementation of a firearm accessory electrical distribution system according to the principles of the present disclosure, wherein fasteners have been omitted for clarity.
Figure 2B:
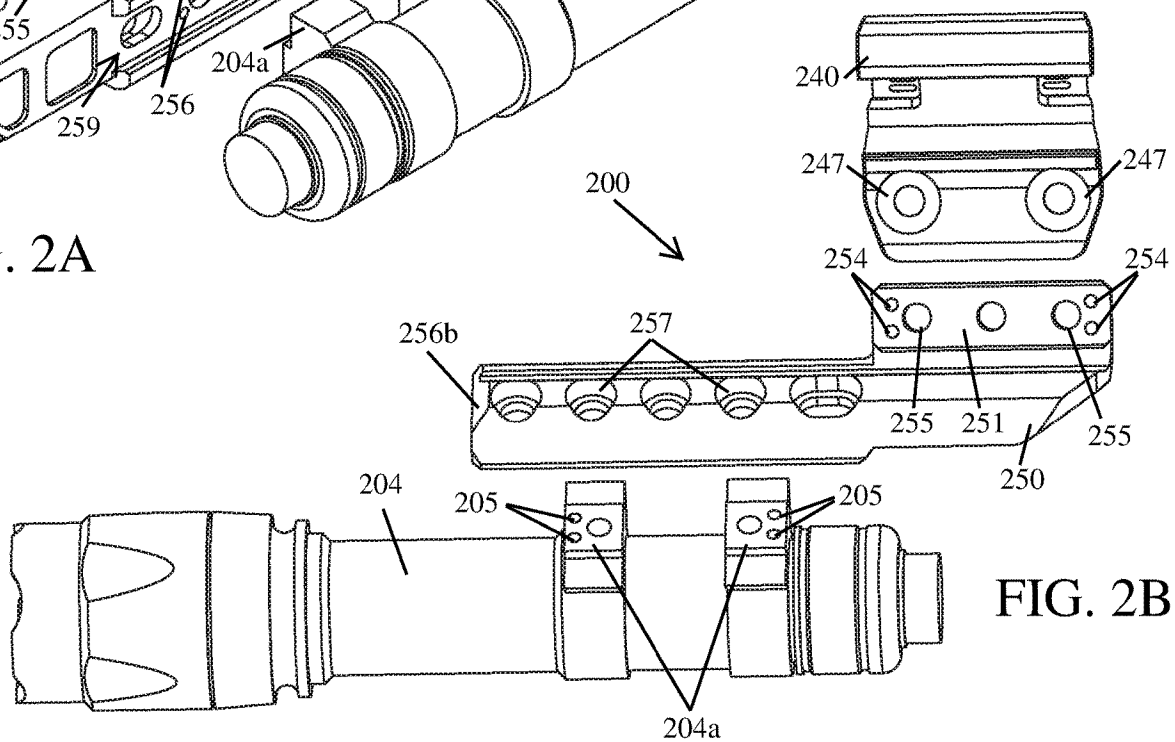

FIGS. 2A and 2B illustrate another example implementation of a firearm accessory electrical distribution system 200 in accordance with the present disclosure. In some implementations, the firearm accessory electrical distribution system 200 is similar to the firearm accessory electrical distribution system 100 discussed above but is comprised of an accessory mount 240 having an integrated switch 242, a mount extension 250, and an illumination device 204. In some implementations, the system 200 may be powered by one or more batteries contained within the illumination device 204.

In some implementations, the accessory mount 240, the mount extension 250, and/or the illumination device 204 of the system 200 may be the same as, or similar to, the accessory mount 140, the mount extension 150, and/or the illumination device 104 described above in connection with FIGS. 1A-1C.

In some implementations, the integrated switch 242 of the accessory mount 240 may be configured to operate (e.g., turn on/off) the illumination device 204 conductively connected thereto via the mount extension 250.

As shown in FIGS. 2A and 2B, in some implementations, a first side 240*a* of the accessory mount 240 may include a mounting interface 248 thereon configured to receive a portion (e.g., element 251) of the mount extension 250 therein.

As shown in FIG. 2A, the mounting interface 248 of the accessory mount 240 may comprise a channel 249 configured to receive the rectangular protrusion 251 extending from the first end 252*a* of the mount extension 250 therein. In some implementations, the channel 249 may be recessed into the first side 240*a* of the accessory mount 240 and bound on two sides by a ridge. In some implementations, the ridges of the channel 249 may be parallel to each other (see, e.g., FIG. 2A). In some implementations, the ridges may not be parallel to each other.

As shown in FIG. 2A, in some implementations, the channel 249 of the mounting interface 248 may further comprise four contacts 244. In some implementations, the four contacts 244 may be conductively connected to the switch 242 of the accessory mount 240. In some implementations, the channel 249 may include more than four, or less than four, contacts 244 therein.

As shown in FIG. 2A, in some implementations, the channel 249 of the mounting interface 248 may also comprise two openings 247 that extend therethrough. In some implementations, each of the openings 247 may be configured to receive a portion of a threaded fastener therein that is used to secure the first end 252*a* of the mount extension 250 to the first side 240*a* of the accessory mount 240. In some implementations, the mounting interface 248 may include more than two, or less than two, openings 247.

As shown in FIGS. 2A and 2B, in some implementations, the mount extension 250 may comprise a first end 252*a* and a second end 252*b*.

As shown in FIG. 2B, in some implementations, the first end 252*a* of the mount extension 250 may comprise a rectangular protrusion 251 having four contacts 254 on a face thereof. In some implementations, the first end 252*a* of the mount extension 250 may further comprise at least two threaded openings 255 that extend therethrough. Each of the threaded openings 255 may be configured to receive a portion of a threaded fastener therein (not shown) that is used to secure the rectangular protrusion 251 of the mount extension 250 within the channel 249 of the accessory mount 240. In some implementations, the mount extension 250 may include more than two, or less than two, threaded openings 255.

As shown in FIGS. 2A and 2B, the second end 252*b* of the mount extension 250 may include a mounting interface 258 thereon configured to receive therein a portion (e.g., elements 204*a*) of a power-consuming firearm accessory (e.g., the illumination device 204).

As shown in FIG. 2A, the mounting interface 258 of the mount extension 250 may comprise a channel 259 configured to receive the rectangular shaped protrusions 204*a* extending from the body of the illumination device 204. In some implementations, the channel 259 may be recessed into the second end 252*b* of the mount extension 250 and bound on two sides by a ridge. In some implementations, the ridges of the channel 259 may be parallel to each other (see, e.g., FIG. 2A). In some implementations, the ridges may not be parallel to each other.

As shown in FIGS. 2A and 2B, in some implementations, the channel 259 of the mounting interface 258 may further comprise four contacts 256 that are conductively connected to the four contacts 254 located on the face of the rectangular protrusion 251 extending from the first end 252*a* of the mount extension 250. In this way, power and/or electronic signals (i.e., data) may pass therebetween. In some implementations, the channel 259 may include more than four, or less than four, contacts 256 therein.

As shown in FIGS. 2A and 2B, in some implementations, the channel 259 of the mounting interface 258 may also comprise at least two openings 257 that extend therethrough. Each opening 257 may be configured to receive therein a portion of a threaded fastener used to secure the rectangular shaped protrusions 204*a* extending from the body of the illumination device 204 to the second end 252*b* of the mount extension 250. In some implementations, the mounting interface 258 may include more than two, or less than two, openings 257.

In some implementations, power and/or electronic signals (i.e., data) may pass through the contacts (e.g., 205, 244, 254, 256) used to conductively connect the accessory mount 240, the extension member 250, and the illumination device 204 together. In this way, the switch 242 of the accessory mount 250 may be used to operate a conductively connected firearm accessories (e.g., the illumination device 204).

In some implementations, the accessory mount 240 may include a mode selector switch (not shown) that is configured to allow a user to change and set the mode of operation (e.g., momentary on, constant on, strobe, a combination thereof, etc.) for any conductively connected firearm accessories (e.g., the illumination device 204) actuated by the switch 142 thereof. In some implementations, the accessory mount 240 may include electronic circuitry configured so that the mode of operation provided thereby is user programmable.

Figure 3A:
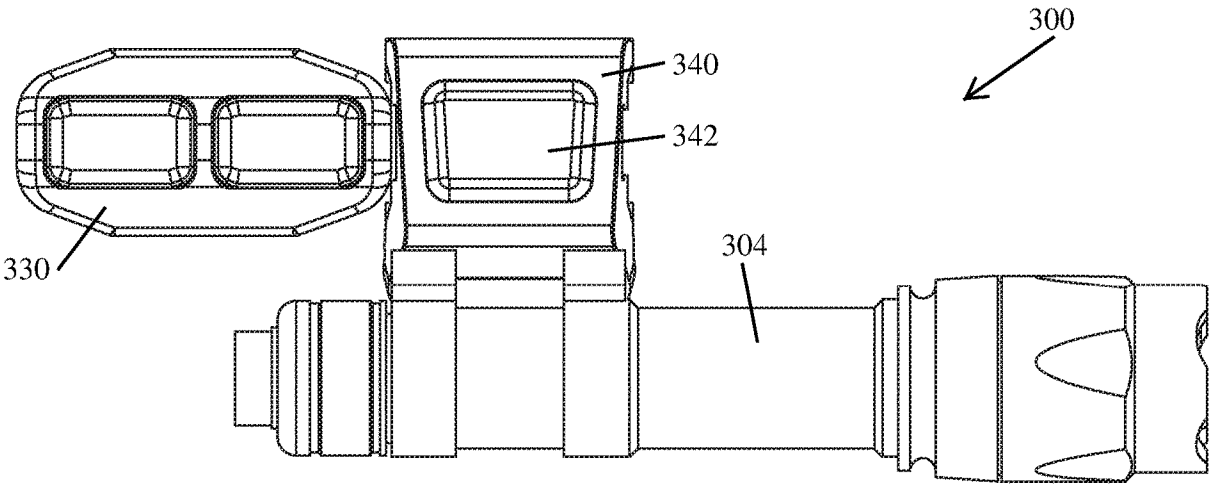
FIGS. 3A and 3B illustrate yet another example implementation of a firearm accessory electrical distribution system according to the principles of the present disclosure, wherein fasteners have been omitted for clarity.
Figure 3B:
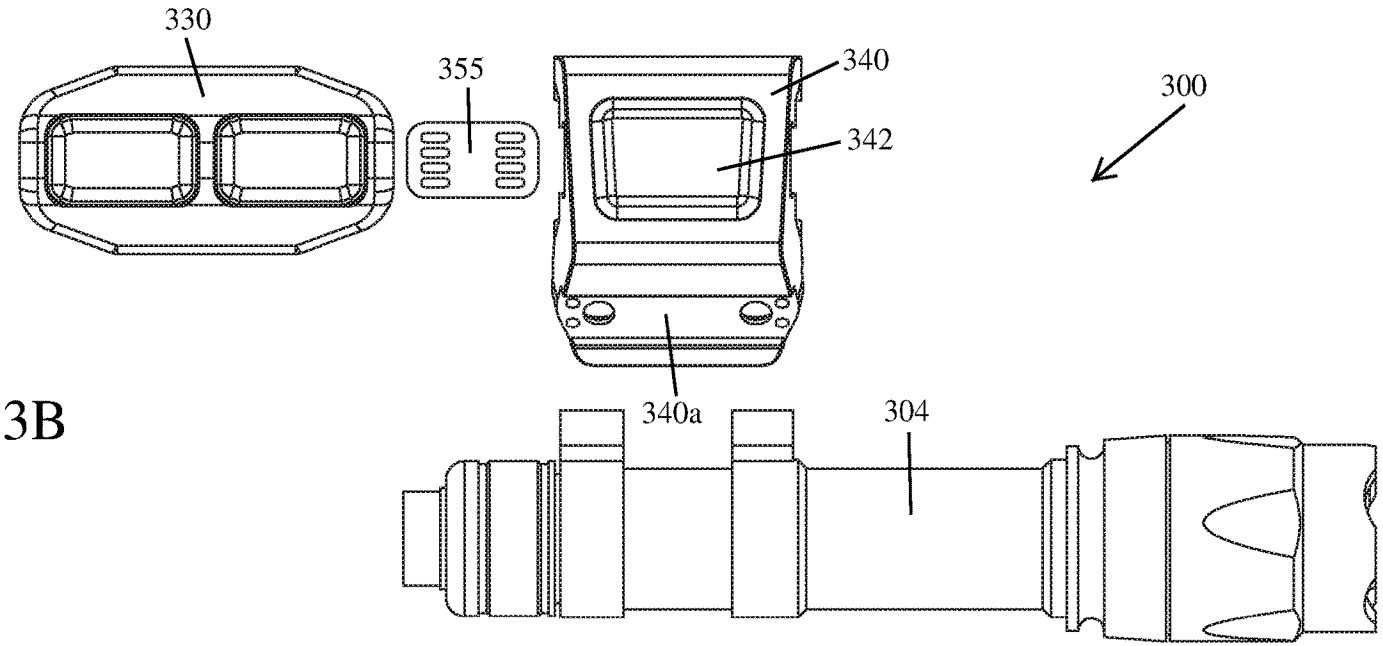

FIGS. 3A and 3B illustrate yet another example implementation of a firearm accessory electrical distribution system 300 in accordance with the present disclosure. In some implementations, the firearm accessory electrical distribution system 300 is similar to the firearm accessory electrical distribution systems 100, 200 discussed above but is comprised of a dual switch assembly 330, an accessory mount 340 having an integrated switch 342, a mating connector 355, and an illumination device 304 removably secured to a first side 340*a* of the accessory mount 340. In some implementations, the system 300 may be powered by one or more batteries contained within the illumination device 304.

In some implementations, the dual switch assembly 330, the accessory mount 340, the mating connector 355, and/or the illumination device 304 may be the same as, or similar to, the dual switch assemblies (130, 230), the accessory mounts (140, 240), the mating connector 155, and/or the illumination devices (104, 204) described above.

In some implementations, the illumination device 304 may be conductively connected to the accessory mount 340 via one or more pairs on contacts. In this way, power and/or electronic signals (i.e., data) may pass therebetween.

In some implementations, the mating connector 355 may be used to conductively connect the dual switch assembly 330 directly to the accessory mount 340. In this way, power and/or electronic signals (i.e., data) may pass therebetween.

Figure 4B:
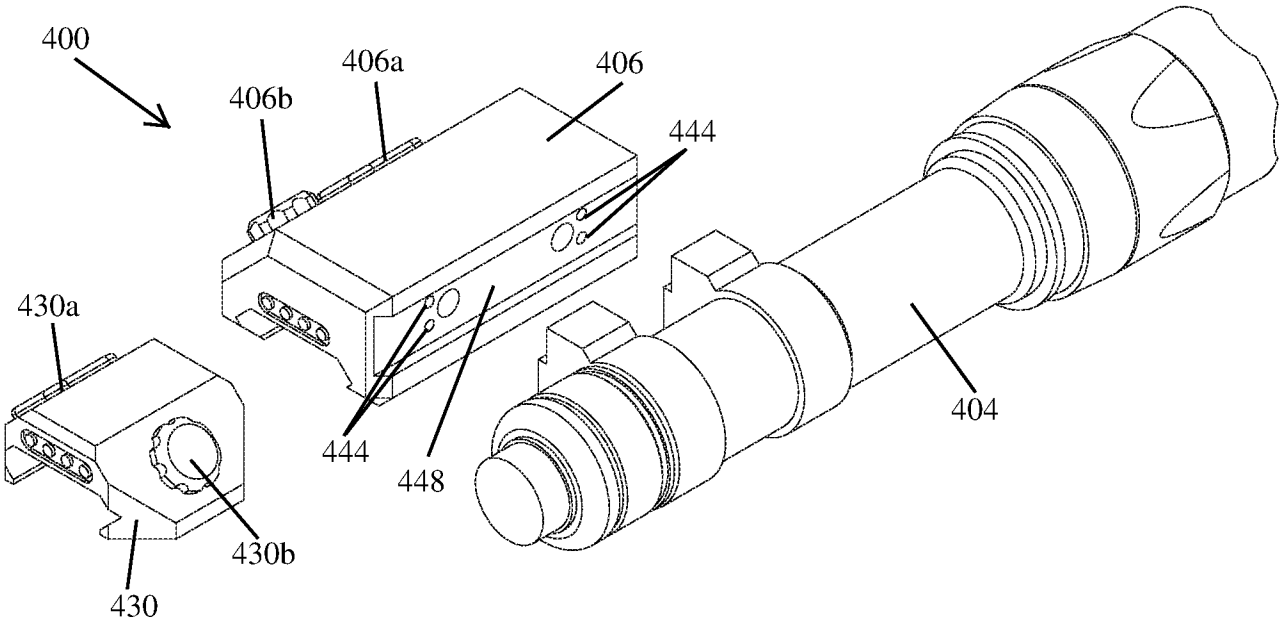
FIGS. 4A and 4B illustrate still yet another example implementation of a firearm accessory electrical distribution system according to the principles of the present disclosure, wherein fasteners have been omitted for clarity.
Figure 4A:
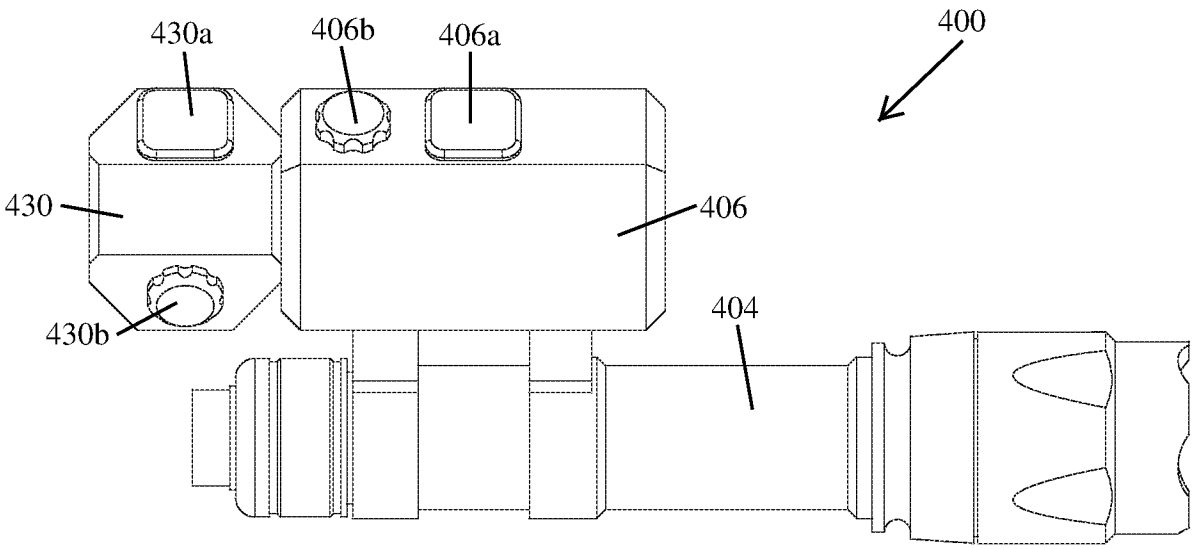

FIGS. 4A and 4B illustrate still yet another example implementation of a firearm accessory electrical distribution system 400 in accordance with the present disclosure. In some implementations, the firearm accessory electrical distribution system 400 is similar to the firearm accessory electrical distribution systems 100, 200, 300 discussed above but comprises a laser aiming module 406, a switch assembly 430, and/or an illumination device 404. In some implementations, the laser aiming module 406 may be configured to act as a visible laser sight and/or an IR laser sight. In some implementations, the system 400 may be powered by one or more batteries contained within the illumination device 404.

In some implementations, the switch assembly 430 and/or the illumination device 404 may be the same as, or similar to, the switch assemblies (130, 230, 330) and/or the illumination devices (104, 204, 304) described above.

As shown in FIGS. 4A and 4B, in some implementations, the laser aiming module 406 may be configured to conductively connect directly to the switch assembly 430 without an intermediary device. In some implementations, the laser aiming module 406 may be configured so that a connector extension (e.g., 120), a mating connector (e.g., 155), or another suitably configured electrical cable may be used to conductively connect it to the switch assembly 430 (not shown).

As shown in FIGS. 4A and 4B, in some implementations, the laser aiming module 406 may comprise a housing having a first switch (or button) 406*a*, a mode selector switch 406*b*, and/or a mounting interface 448 positioned on a first side thereof.

In some implementations, the housing of the laser aiming module 406 may be configured so that a bottom side thereof can be secured to a MIL-STD-1913 rail, also referred to as a Picatinny rail. In some implementations, the housing of the laser aiming module 406 may be configured so that a bottom side thereof may be secured to one or more negative space mounting slots (e.g., M-LOK standard and/or KeyMod standard negative space mounting slot(s)).

In some implementations, the first switch 406*a* of the laser aiming module 406 can be configured to operate (e.g., activate) the laser(s) of the laser aiming module, and/or any firearm accessories conductively connected thereto, when actuated.

In some implementations, the mode selector switch 406*b* of the laser aiming module 406 may be configured to change and set the mode of operation (e.g., momentary on, constant on, strobe, etc.) for any firearm accessory (e.g., the illumination device 404 and/or laser aiming module 406) actuated by a conductively connected switch (e.g., 406*a*) of the system 400. In some implementations, the mode selector switch 406*b* of the laser aiming module 406 may be used selectively power firearm accessories (e.g., the illumination device 404) conductively connected to the first switch 406*a* of the laser aiming module 406.

As shown in FIG. 4B, in some implementations, the mounting interface 448 of the laser aiming module 406 may be the same as, or similar to, the mounting interface 248 described above in connection with the accessory mount 240 shown in FIGS. 2A and 2B. In this way, the illumination device 404 may be secured directly to the laser aiming module 406 (see, e.g., FIG. 4A). In some implementations, the illumination device 404 may be conductively connected to the laser aiming module 406 via one or more pairs on contacts 444 positioned in the mounting interface 448. In this way, power and/or electronic signals (i.e., data) may pass therebetween.

As shown in FIGS. 4A and 4B, in some implementations, the switch assembly 430 of the system 400 may comprise a first switch (or button) 430*a*, and/or a mode selector switch 430*b*. In some implementations, the mode selector switch 430*b* of the switch assembly 430 may be configured to change and set the mode of operation (e.g., momentary on, constant on, strobe, etc.) for any firearm accessory (e.g., the illumination device 404 and/or laser aiming module 406) actuated by a conductively connected switch (e.g., 430*a*) of the system 400. In some implementations, the mode selector switch 430*b* of the switch assembly 430 may be used selectively power firearm accessories (e.g., the illumination device 404 or the laser aiming module 406) conductively connected to the first switch 430*a* of the switch assembly 430.

In some implementations, the switch assembly 430 may be rotated 180 degrees relative to the surface on which it is mounted so that the orientation of the first switch 406*a* and the mode selector switch 430*b*, relative to the user, is reversed.

In some implementations, each mode selector switch 406*b*, 430*b* of the firearm accessory electrical distribution system 400 may be a rotary switch, or another suitable switch type known to one of ordinary skill in the art.

In some implementations, each mode selector switch 406*b*, 430*b* of the firearm accessory electrical distribution system 400 may include electronic circuitry configured so that the mode of operation provided thereby is user programmable. In this way, for example, the user may select between individual activation or joint activation of any firearm accessories (e.g., the laser of the laser aiming module 406 and/or the illumination device 404) actuated using a conductively connected switch (e.g., 406*a*, 430*a*) of the system 400.

Figure 5A:
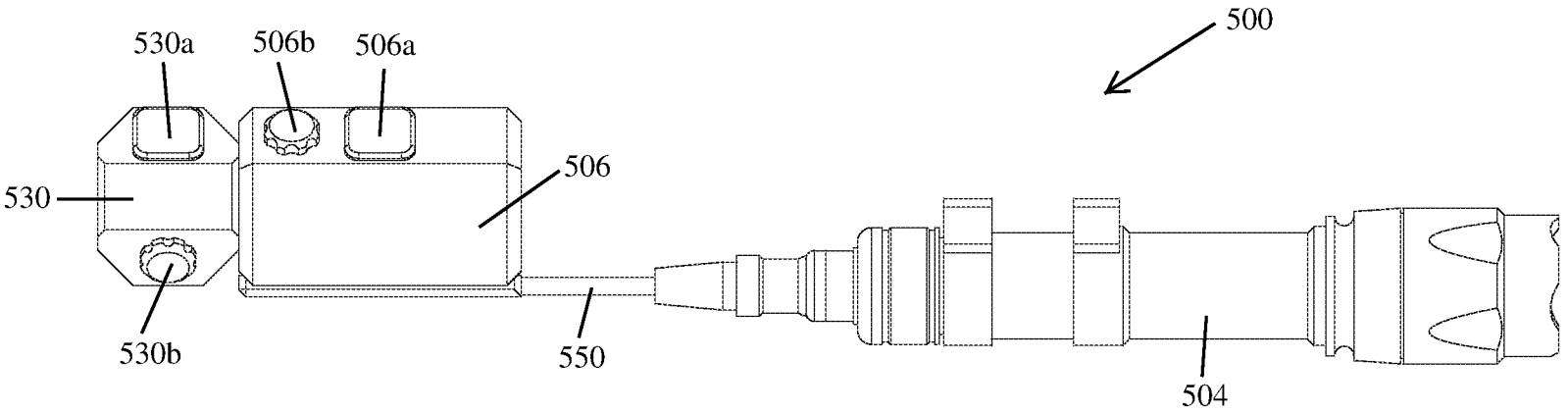
FIGS. 5A and 5B illustrate yet another example implementation of a firearm accessory electrical distribution system according to the principles of the present disclosure, wherein fasteners have been omitted for clarity.
Figure 5B:
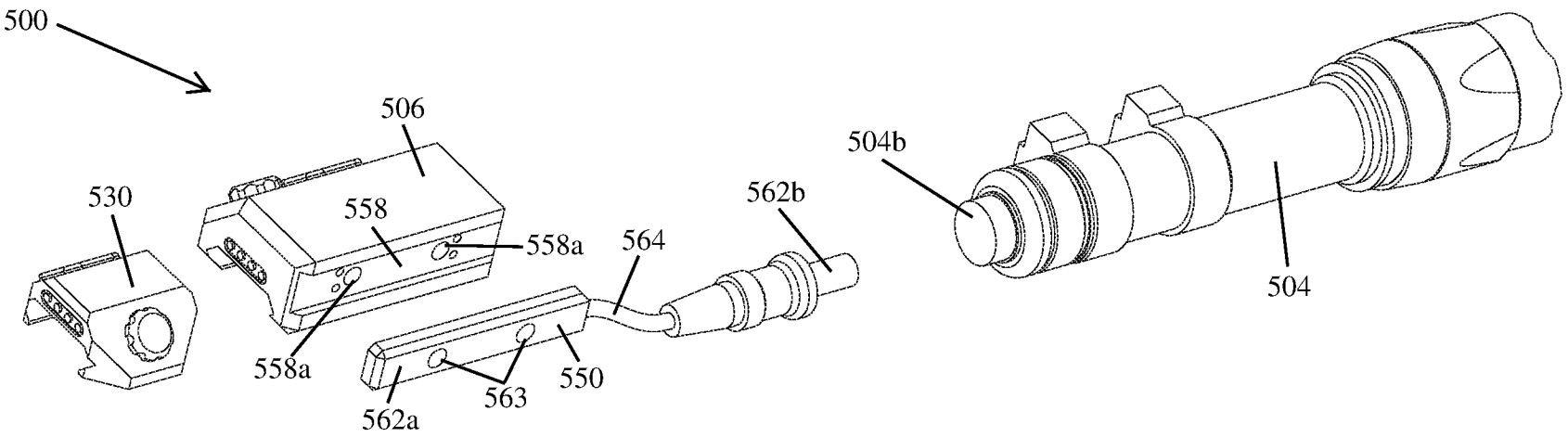

FIGS. 5A and 5B illustrate yet another example implementation of a firearm accessory electrical distribution system 500 in accordance with the present disclosure. In some implementations, the firearm accessory electrical distribution system 500 is similar to the firearm accessory electrical distribution systems 100, 200, 300, 400 discussed above, in particular the firearm accessory electrical distribution system 400 shown in FIGS. 4A and 4B, but includes a remote cable adaptor 550 configured to conductively connect an illumination device 504 to the laser aiming module 506 and the one or more switches (e.g., 506*a*, 530*a*) of the system 400. In this way, a user may be afforded more flexibility when positioning the illumination device 504 on the handguard, or other portion, of a firearm (e.g., a rifle).

As shown in FIGS. 5A and 5B, in some implementations, the remote cable adaptor 550 may comprise a first connector 562*a* and a second connector 562*b* having a cable 564 extending therebetween, the first connector 562*a* of the remote cable adaptor 550 may be configured to be removably received within the mounting interface 558 of the laser aiming module 506 and the second connector 562*b* may be configured to interface with the power socket of a legacy device (e.g., the tail cap 504*b* of the illumination device 504). In this way, for example, the remote cable adaptor 550 may be used to conductively connect the illumination device 504 to the laser aiming module 506 and the switch assembly 530, thereby allowing power and/or electronic signals (i.e., data) to pass therebetween. In some implementations, the first connector 562*a* of the remote cable adaptor 550 may be a longitudinally extending member having the general shape of a rectangle (see, e.g., FIG. 5B).

In some implementations, the remote cable adaptor 550 may be configured to allow for a series and/or parallel connection between one or more switches (e.g., 506*a*, 506*b*, 530*a*, 530*b*) of the system 500 and/or other accessories (e.g., the illumination device 504) conductively connected to the system 500.

In some implementations, one or more threaded fasteners may be used to secure the first connector 562*a* of the remote cable adaptor 550 to the mounting interface 558 of the laser aiming module 506. In some implementations, a threaded fastener may extend through each opening 563 in the first connector 562*a* portion of the remote cable adaptor 550 and be threadedly secured within a corresponding opening 558*a* in the mounting interface 558 of the laser aiming module 506.

In some implementations, each of the firearm accessory electrical distribution systems 200, 300, 400, and/or 500 may be powered by a battery pack (e.g., 110) conductively connected thereto using a connector extension (e.g., 120), a mating connector (e.g., 155, 355), and/or any other device suitably configured for conductively connecting the system 200, 300, 400, 500 to a battery pack.

FIG. 6 illustrates an example computer display 601 showing an interface 605 of a computer implemented program (or application) that may be used to configure the operation of firearm accessories conductively connected to a firearm accessory electrical distribution system 100, 200, 300, 400, and/or 500. In this way, for example, the user may change and set the mode of operation for any firearm accessories conductively connected to, or integrated with (e.g., the laser aiming module 406, 506), the system 100, 200, 300, 400, 500.

In some implementations, as shown in FIG. 6, Device 1 may be a laser aiming module (e.g., 406, 506) and Device 2 may be an illumination device (e.g., 104, 204, 304, 404, 504). In some implementations, as shown in FIG. 6, Button 1 may be a first switch (e.g., 430*a*, 530*b*) of a laser aiming module and Mode 1 may be a mode selector switch (e.g., 406*b*, 506*b*) thereof. In some implementations, as shown in FIG. 6, Button 2 may be a first switch (e.g., 430*a*, 530*a*) of a switch assembly and Mode 2 may be a mode selector switch (e.g., 430*b*, 530*b*) thereof.

In some implementations, the interface 605 of the computer implemented program may be configured so that a user can use one or more drop down menus 610 to select the one or more devices to be used as part of a firearm accessory electrical distribution system (e.g., 400). In some implementations, the interface 605 of the computer implemented program may be configured so that a user can use one or more drop down menus 620 to select which device, or combination of devices, may be activated when a mode selector switch (e.g., Mode 1) is placed in a specific position (e.g., M1A, M1B, M1C) and a switch (e.g., Button 1, Button 2) of the system (e.g., 400) is actuated (i.e., pressed).

The example computer display 601 shown in FIG. 6 discloses several example configurations for the operation of the firearm accessory electrical distribution system (i.e., system 400) illustrated in connection therewith. While the example configurations are described in connection with the firearm accessory electrical distribution system 400 shown in FIGS. 4A and 4B, the computer implemented program could be used to configure the operation of firearm accessories conductively connected to any firearm accessory electrical distribution system 100, 200, 300, and/or 500 disclosed herein.

As shown in FIG. 6, the function of Button 1 and Button 2 are as follows:

Configuration Name: "Button 1—M1A" indicates that when Mode 1 (i.e., mode selector switch 1) is in position A, pressing Button 1 will activate the visible laser of Device 1;

Configuration Name: "Button 1—M1B" indicates that when Mode 1 (i.e., mode selector switch 1) is in position B, pressing Button 1 will activate the IR laser of Device 1;

Configuration Name: "Button 1—M1C" indicates that when Mode 1 (i.e., mode selector switch 1) is in position C, pressing Button 1 will activate the IR laser of Device 1;

Configuration Name: "Button 2—M1A" indicates that when Mode 1 (i.e., mode selector switch 1) is in position A, pressing Button 2 will activate the visible laser of Device 1 and activate Device 2 (i.e., cause the illumination device to emit visible light);

Configuration Name: "Button 2—M1B" indicates that when Mode 1 (i.e., mode selector switch 1) is in position B, pressing Button 2 will activate the IR laser of Device 1 and activate Device 2 (i.e., cause the illumination device to emit IR light); and Configuration Name: "Button 2—M1C" indicates that when Mode 1 (i.e., mode selector switch 1) is in position C, pressing Button 2 will activate the IR illuminator of Device 2 only.

Configuration Name: "Mode 2 Function" indicates that when Mode 2 (i.e., mode selector switch 2) is in a first position, power is shared between the devices of the firearm accessory electrical distribution system 400.

As used throughout the specification and in the drawings, a contact is one-half of a contact pair. In some implementations, each contact comprises an electrically conductive surface which is electrically connected to a power source or a power consuming device. In some implementations, a contact pair may comprise a set of two contacts which, when brought together in mechanical contact, complete an electrical circuit. In this way, power and/or electronic signals (i.e., data) may pass therebetween.

In some implementations, the housing of the battery pack 110, switch assemblies (e.g., 130, 330, 430, 530), accessory mounts (e.g., 140, 240, 340), and/or laser aiming modules (e.g., 406, 506) may be made of an impact resistant polymer. In some implementations, the housing of the battery pack 110, switch assemblies (e.g., 130, 330, 430, 530), accessory mounts (e.g., 140, 240, 340), and/or laser aiming modules (e.g., 406, 506) may be made of an aluminum alloy. In some implementations, the housing of the battery pack 110, switch assemblies (e.g., 130, 330, 430, 530), accessory mounts (e.g., 140, 240, 340), and/or laser aiming modules (e.g., 406, 506) may be made of any material suitable for use as part of a firearm accessory electrical distribution system 100, 200, 300, 400, 500.

In some implementations, the mount extensions 150, 250 may be made of an impact resistant polymer. In some implementations, the mount extensions 150, 250 may be made of an aluminum alloy. In some implementations, the mount extensions 150, 250 may be made of any material suitable for use as part of a firearm accessory electrical distribution system 100, 200, 300, 400, 500.

Although not shown in the drawings, it will be understood that suitable wiring and/or traces connects the electrical components of the firearm accessory electrical distribution systems 100, 200, 300, 400, 500 disclosed herein.

In some implementations, the method or methods described above in connection with the computer implemented program (or application) may be executed or carried out by a computing system including a tangible computer-readable storage medium, also described herein as a storage machine, that holds machine-readable instructions executable by a logic machine (i.e. a processor or programmable control device) to provide, implement, perform, and/or enact the above described methods, processes and/or tasks. When such methods and processes are implemented, the state of the storage machine may be changed to hold different data. For example, the storage machine may include memory devices such as various hard disk drives, CD, or DVD devices. The logic machine may execute machine-readable instructions via one or more physical information and/or logic processing devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements of the disclosed system and/or method are displayed on a display screen for user consumption. The computing system may include an input subsystem that receives user input. The input subsystem may be configured to connect to and receive input from devices such as a mouse, keyboard, or gaming controller. For example, a user input may indicate a request that a certain task is to be executed by the computing system, such as requesting the computing system to display any of the above described information, or requesting that the user input updates or modifies existing stored information for processing. A communication subsystem may allow the methods described above to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as via an application programming interface (API).

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A firearm accessory electrical distribution system comprising:

an accessory mount, the accessory mount comprises a housing that includes a bottom side configured to be secured to a mounting interface for firearm accessories, a first side that includes a mounting interface thereon, and a first switch configured to operate at least one firearm accessory conductively connected to the firearm accessory electrical distribution system; and a mount extension configured to conductively connect a firearm accessory secured thereon to the firearm accessory electrical distribution system, the mount extension comprises a first end that is configured to conductively interface with the mounting interface of the accessory mount and a second end that is configured to conductively interface with a firearm accessory secured thereon;

wherein the mount extension is configured so that it laterally offsets the firearm accessory secured thereon from a longitudinal axis of the mounting interface for firearm accessories to which the accessory mount is secured.

2. The firearm accessory electrical distribution system of claim 1, wherein the firearm accessory electrical distribution system is configured so that the first switch of the accessory mount can be used to change and set the mode of operation for at least one firearm accessory conductively connected thereto.

3. The firearm accessory electrical distribution system of claim 1, further comprising an interface connector configured to conductively connect a firearm accessory to the firearm accessory electrical distribution system, the interface connector comprises a first connector and a second connector having a cable extending therebetween, the first connector is configured to conductively interface with a first connector interface in the housing of the accessory mount and the second connector is configured to conductively interface with a power socket of a firearm accessory.

4. The firearm accessory electrical distribution system of claim 3, wherein the firearm accessory electrical distribution system is configured so that the first switch of the accessory mount can be used to change and set the mode of operation for at least one firearm accessory conductively connected thereto.

5. The firearm accessory electrical distribution system of claim 1, further comprising a switch assembly that is conductively connected to the accessory mount, the switch assembly comprises a housing that includes a bottom side configured to be secured to the mounting interface for firearm accessories and a first switch configured to operate at least one firearm accessory conductively connected to the firearm accessory electrical distribution system.

6. The firearm accessory electrical distribution system of claim 5, wherein the firearm accessory electrical distribution system is configured so that the first switch of the accessory mount and the first switch of the switch assembly can be used to change and set the mode of operation for at least one firearm accessory conductively connected thereto.

7. The firearm accessory electrical distribution system of claim 5, further comprising a mating connector configured to conductively connect the switch assembly to the accessory mount, the mating connector is a discrete component and comprises a first connector positioned directly adjacent a second connector, the first connector is configured to conductively interface with a first connector interface in the housing of the switch assembly and the second connector is configured to conductively interface with a first connector interface in the housing of the accessory mount.

8. The firearm accessory electrical distribution system of claim 1, further comprising a battery pack configured to power the firearm accessory electrical distribution system, the battery pack is conductively connected to the accessory mount and comprises a housing that includes a bottom side configured to be secured to the mounting interface for firearm accessories.

9. The firearm accessory electrical distribution system of claim 8, further comprising a connector extension configured to conductively connect the battery pack to the accessory mount, the connector extension comprises a first connector and a second connector having a cable extending therebetween, the first connector is configured to conductively interface with a first connector interface in the housing of the battery pack and the second connector is configured to conductively interface with a first connector interface in the housing of the accessory mount.

10. The firearm accessory electrical distribution system of claim 8, wherein the battery pack further comprises a mode selector switch, the mode selector switch is configured to change and set the mode of operation for at least one firearm accessory conductively connected to the firearm accessory electrical distribution system.

11. A firearm accessory electrical distribution system comprising:

an accessory mount, the accessory mount comprises a housing that includes a bottom side configured to be secured to a mounting interface for firearm accessories, a first side that includes a mounting interface thereon, and a first switch configured to operate at least one firearm accessory conductively connected to the firearm accessory electrical distribution system;

wherein the mounting interface of the accessory mount is configured to conductively connect a firearm accessory secured thereon to the firearm accessory electrical distribution system;

wherein the mounting interface of the accessory mount is configured to laterally offset the firearm accessory secured thereon from a longitudinal axis of the mounting interface for firearm accessories to which the accessory mount is secured.

12. The firearm accessory electrical distribution system of claim 11, wherein the firearm accessory electrical distribution system is configured so that the first switch of the accessory mount can be used to change and set the mode of operation for at least one firearm accessory conductively connected thereto.

13. The firearm accessory electrical distribution system of claim 11, further comprising a switch assembly that is conductively connected to the accessory mount, the switch assembly comprises a housing that includes a bottom side configured to be secured to the mounting interface for firearm accessories and a first switch configured to operate at least one firearm accessory conductively connected to the firearm accessory electrical distribution system.

14. The firearm accessory electrical distribution system of claim 13, further comprising a mating connector configured to conductively connect the switch assembly to the accessory mount, the mating connector comprises a first connector positioned directly adjacent a second connector, the first connector is configured to conductively interface with a first connector interface in the housing of the switch assembly and the second connector is configured to conductively interface with a first connector interface in the housing of the accessory mount.

15. The firearm accessory electrical distribution system of claim 11, further comprising a battery pack configured to power the firearm accessory electrical distribution system, the battery pack is conductively connected to the accessory mount and comprises a housing that includes a bottom side configured to be secured to the mounting interface for firearm accessories.

16. The firearm accessory electrical distribution system of claim 15, further comprising a connector extension configured to conductively connect the battery pack to the accessory mount, the connector extension comprises a first connector and a second connector having a cable extending therebetween, the first connector is configured to conductively interface with a first connector interface in the housing of the battery pack and the second connector is configured to conductively interface with a first connector interface in the housing of the accessory mount.

17. The firearm accessory electrical distribution system of claim 15, wherein the battery pack further comprises a mode selector switch, the mode selector switch is configured to change and set the mode of operation for at least one firearm accessory conductively connected to the firearm accessory electrical distribution system.

* * * * *